United States Patent [19]

Wick, Jr. et al.

[11] 4,267,942

[45] May 19, 1981

[54] PHARMACEUTICAL DISPENSING CABINET

[75] Inventors: John B. Wick, Jr., Box 578 R.D. 2, Parkesburg, Pa. 19365; Eric C. Norlin, 90 Hilltop Rd., Coatesville, Pa. 19320

[73] Assignees: John B. Wick, Jr.; Eric C. Norlin, both of Chester, Pa.

[21] Appl. No.: 50,930

[22] Filed: Jun. 20, 1979

[51] Int. Cl.[3] ..... A47B 67/02

[52] U.S. Cl. ..... 221/2; 221/92; 221/154; 221/282; 312/209; 194/4 R

[58] Field of Search ..... 221/2, 4, 92, 123, 133, 221/154, 282; 312/209; 194/4 R

[56] References Cited

U.S. PATENT DOCUMENTS

| | | | |
|---|---|---|---|
| 768,968 | 8/1904 | Sweet . | |
| 979,596 | 12/1910 | Sullivan . | |
| 1,575,972 | 3/1926 | Cochran . | |
| 1,984,893 | 12/1934 | Rinaldi . | |
| 2,342,452 | 2/1944 | Casteen | 221/92 X |
| 3,172,713 | 3/1965 | Rupert . | |
| 3,515,265 | 6/1970 | Bartnik . | |
| 3,685,692 | 8/1972 | Erne et al. | 222/23 |
| 3,762,601 | 10/1973 | McLaughlin | 221/2 |
| 4,019,793 | 4/1977 | Gerding . | |
| 4,054,343 | 10/1977 | Heyland | 312/209 |

*Primary Examiner*—Joseph J. Rolla

*Attorney, Agent, or Firm*—Louis S. Gillow

[57] ABSTRACT

A restricted pharmaceutical storage and dispensing cabinet which has a main supporting shell and a stock supporting rack internally of the shell, having vertically and horizontally aligned rows of stock supporting cubicles. The rack is secured by an inner closure which includes an operating panel affording limited access to items of stock. A mechanical locking arrangement is provided for locking and unlocking the inner closure. The operating panel is accessible through an outer locked shell with an unlocking arrangement which include an electrical key reader and readable operator assigned keys. A recording system is provided [with provision] for automatic accountability of items dispensed, date and time of removal and identification of recipient.

11 Claims, 10 Drawing Figures

PHARMACEUTICAL DISPENSING CABINET

BACKGROUND OF THE INVENTION

1. Field of the Invention

This invention relates to storage and dispensing cabinets with particular reference to improvements in restricted pharmaceutical after-hours cabinets.

2. Discussion of the Prior Art

In the absence of primary hospital pharmacy availability, after-hours locked door medication stations afford restricted access to medical supplies. Heretofore, however, inventory control and personal accountability for removal of items have lacked thoroughness.

While the customary limited distribution of cabinet keys may avoid unauthorized access to after-hours pharmacy cabinets, prior art handwritten or similar documentation of pharmaceutical removal has been subject to failure of timely and/or accurate drug accountability and, at best, is tedious and overly time consuming to reconcile.

Accordingly, it is an object of this invention to provide for secure storage of medications with controlled access and reliable accountability for items dispensed.

Another object is to provide for automatic documentation of items dispensed with date and time of removal and identification of recipient.

Still another object is to render medication selection quick, easy and accurate with an assurance of first-in, first-out turnover of inventory.

Other objects and advantages of the invention will become apparent from the following discription.

SUMMARY OF THE INVENTION

The foregoing objects and corollaries are accomplished by provision of a locked cabinet containing a medicine rack comprised of rows of horizontally and vertically aligned juxtapositioned cubicles each adapted to receive a stack of prepackaged pharmaceuticals. Arrangement is made for one at a time, bottom only, ejection of packages of respective stacks wherewith first item in, first item out turnover of inventory may be assured by top loading of replacement stock.

Access to the cabinet is restricted to holders of electrically readable keys permitting door opening which exposes package push-out orifices. These orifices are aligned with ejectable bottom packages of respective stacks.

With an available probe and identification of medicines provided adjacent each push-out orifice, selected packages are pushed from their supporting cubicles into a fall space and retrieval tray.

Automatic identification of ejected packages is accomplished with vertical and horizontal electrical switch operating vanes, one extending vertically across each vertical row of superimposed cubicles and one across each horizontal row of cubicles. With entrance of the probe through a push-out orifice into a selected cubicle, a corresponding vertical vane is mechanically displaced for activation of its electrical switch. Pushing of the pharmaceutical package into the cabinet fall space mechanically displaces the corresponding horizontal vane and activates its electrical switch. All vertical and horizontal vane switches are electrically interconnected with electrical discriminating means having a date and time recording function which, in turn, activates a tape printer for recording the vertical and horizontal vane operation, i.e. identifying cubicle location.

Cabinet door opening and closing by electrical key reading is recorded whereby automatic inventory control and provision for reconciliation of drug usage is afforded.

Details of the invention will become more readily apparent from the following description when taken in conjunction with the accompanying drawings.

IN THE DRAWINGS

DESCRIPTION OF THE PREFERRED EMBODIMENTS

Figure 1:
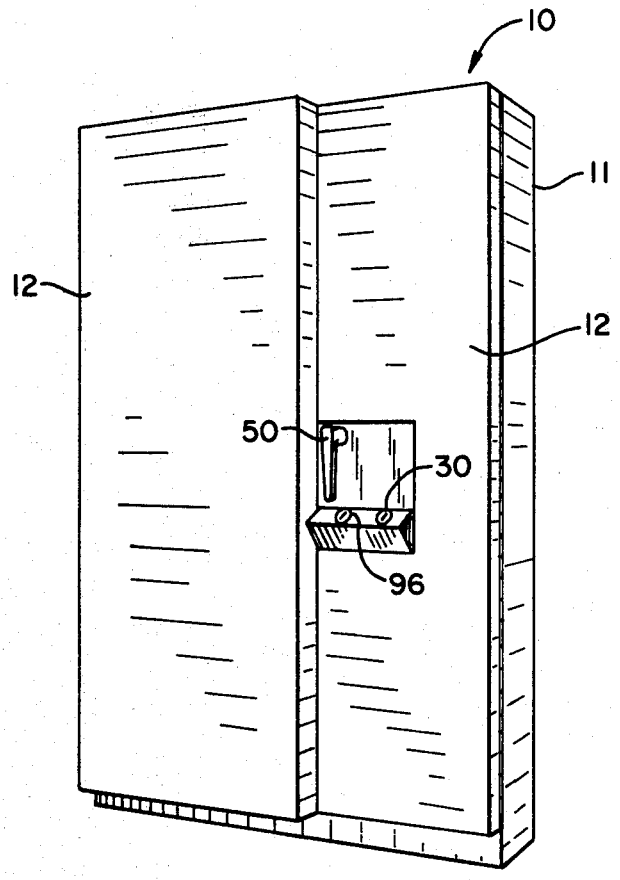
FIG. 1 is an illustration, in perspective, of a preferred embodiment of the present pharmaceutical cabinet.

Referring to the drawings, cabinet 10 comprises main supporting shell 11 having outer doors 12 (FIGS. 1 and 2) and inner doors 14, (FIGS. 2 and 3) respectively providing outer and inner cabinet closures. Shell 11 is preferably formed of sheet metal.

The opening of outer doors 12 provides access to stock selection and dispensing panels 16, stock retrieval tray 18 and supply drawers 20.

Figure 3:
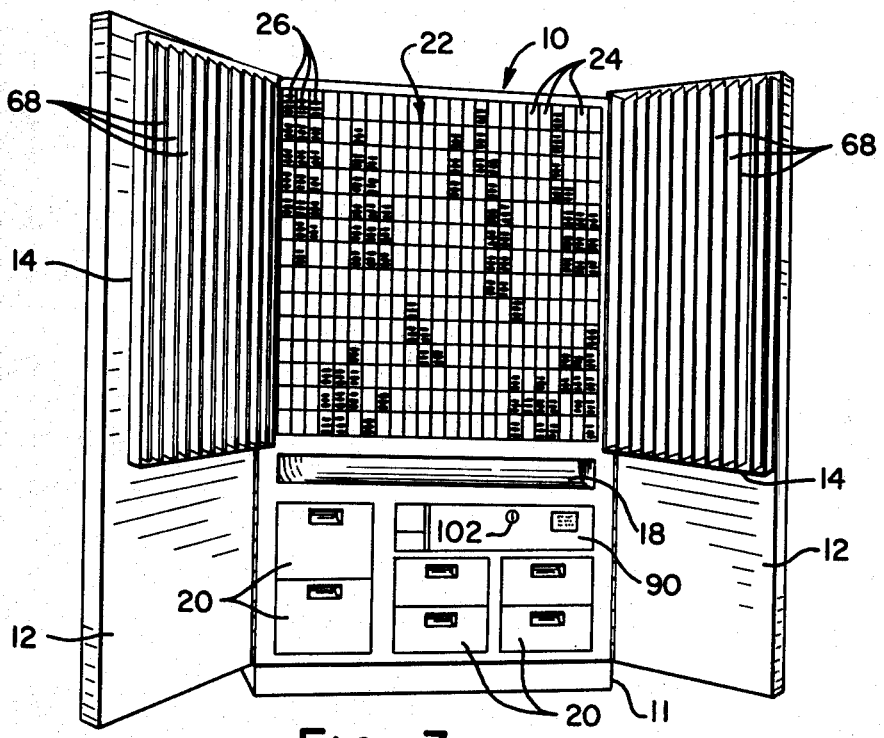
FIG. 3 is a similar view of the cabinet with outer and inner doors open for stock replacement.

Panels 16, being forward components of inner doors 14, are hinged to an out of the way position when inner doors 14 are opened to expose stock rack 22 (FIG. 3).

Rack 22, preferably formed of sheet metal is provided with a multiplicity of vertically and horizontally aligned rows of juxtapositioned cubicles 24. Cubicles 24 are of width, height and depth dimensions precontrolled to each intimately support a vertically stacked array of packages 26 usually filled with identical pharmaceuticals.

Each cubicle 24, while being completely forwardly open as shown in FIG. 3 for restocking, is provided with a rearward barrier 28 (FIGS. 5 and 7) permitting bottom package dispensing only into retrieval tray 18. Accordingly, by proper top loading of cubicles 24, a first package in, first package out turnover of inventory may be assured.

Access to inner door operating panels 16 of cabinet 10 is restricted by outer door electrical key reading means and selective key assignment.

Key slot 30 (FIG. 1) receives electrically readable key 32 (FIG. 9) which, when fully entered into slot 30, is received by key reader 34 located internally of outer door 12. Key reader 34 may be of any commercially or otherwise available form. One such item is model K 107 which is available from Facit Addo Inc. of Greenwich, Connecticut.

Upon insertion of key 32 into slot 30, reader 34 activates main electrical control unit 36 having a date and time keeping function which, in turn, activates suitable recording means such as tape printer 38. Paper tape printing means suitable for the purpose of this invention is Olivette Model Number PV 1100 supplied by Olivetti Corporation of America, Harrisburg, Pennsylvania.

Figure 10:
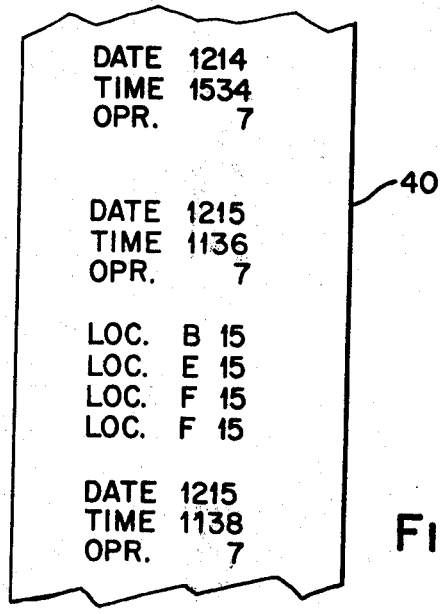
FIG. 10 illustrates an exemplary form of taped documentation of present cabinet use.

FIG. 10 illustrates a typical recording tape 40 and manner of displaying (printing) data which fulfills the requirements of this invention.

Figure 9:
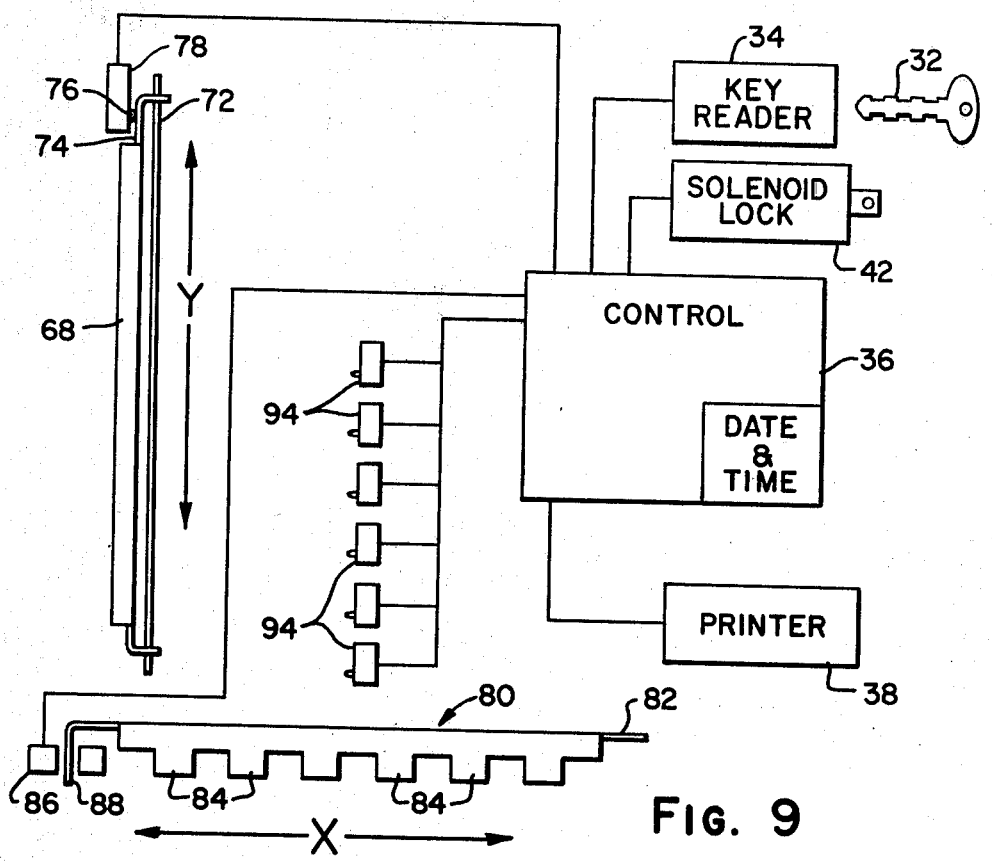
FIG. 9 illustrates, in schematic fashion, the cabinet security and drug documenting features of the present invention.

With reader 34 identifying the particular key 32 used (i.e. assigned operator number), the date, time and operator number are recorded, e.g. as depicted at the top of FIG. 9.

Figure 2:
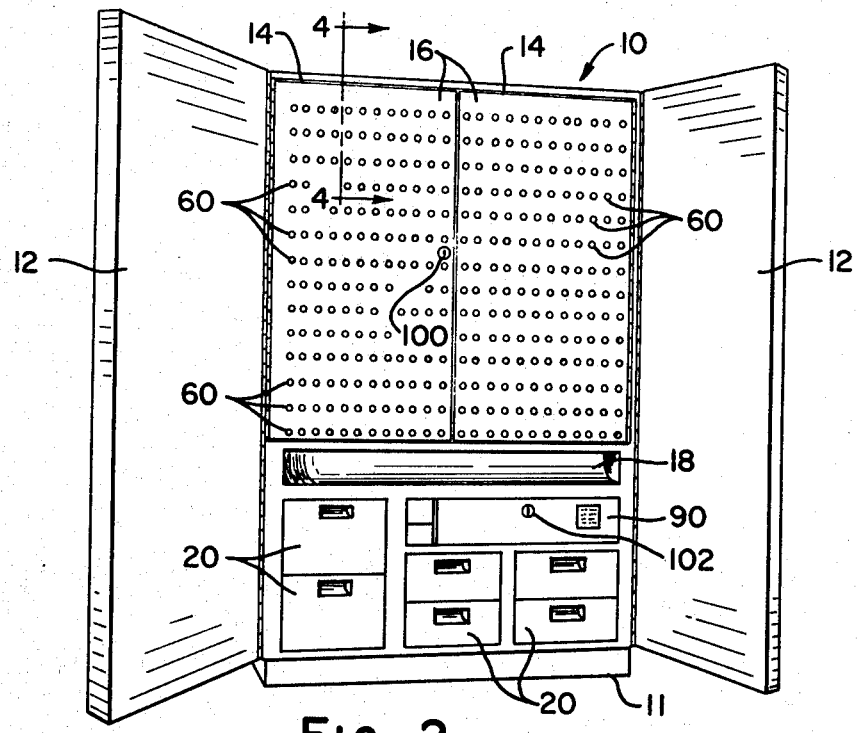
FIG. 2 is a view of the cabinet taken with outer doors open for access to an operating panel and stock retrieval tray.
Figure 8:
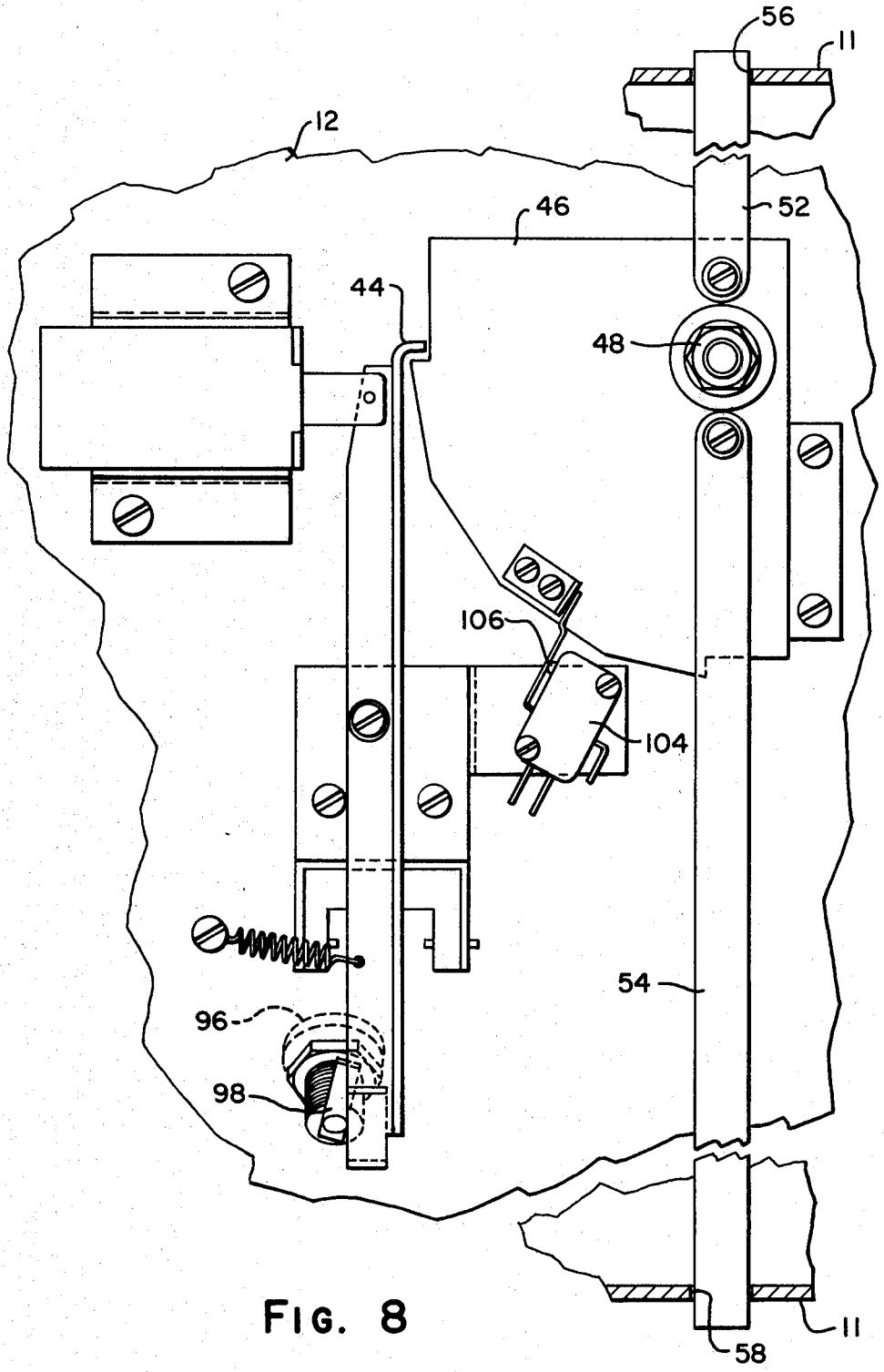
FIG. 8 is a fragmentary rear elevational view of a main cabinet door illustrating a portion of its latch and lock mechanism.

Simultaneously, or with delay if desired, control unit 36 responds to the use of key 32 by energizing solenoid 42 (FIG. 8) which releases latch 44 from latch plate 46. By such means, latch plate 46 may be rotated clockwise as viewed in FIG. 8 by handle 50 (FIG. 1) to withdraw locking bars 52 and 54 from respective upper and lower locking slots 56 and 58 in cabinet shell 11. Nut 48 fastens plate 46 to handle 50. This allows outer doors 12 to be opened as illustrated in FIG. 2 giving access to operating panels 16 for selection and dispensing of desired stock.

Referring more particularly to FIGS. 2, 4, 5 and 6, it will be seen that operating panels 16 are provided with rows of circular openings each fitted with a bushing 60 through which a provided probe 62 (FIGS. 4 and 5) may be inserted for ejection of selected packages 26. To this end, each bushing 60 is approximately centrally aligned with a respective package-emitting opening 64 (FIG. 4) in stock rack 22. Thus, by pushing probe 62 through bushing 60, it is guided into engagement with the lowermost package 26 in a particular cubicle 24 and forces this package out of rack 22 into fall space 66 therebehind as shown with broken line illustration in FIG. 4. Fall space 66 extends downwardly to retrieval tray 18 (FIG. 2) where selected and ejected packages 26 may be reached by the operator.

Retraction and/or removal of probe 62 permits the next package 26 to drop to a position for ejection through opening 64, and so on until the cubicle is emptied.

Automatic detection and recording of locations of particular cubicles probed, i.e. for identification of packages so dispensed, is accomplished electromechanically as follows:

Behind operating panels 16 of inner doors 14, and aligned directly forwardly of each vertical row of superimposed cubicles 24, is a vertical (Y axis) probe sensing vane 68 (FIGS. 3, 4, 5, 6 and 9). Vanes 68, biased by springs 70, normally assume the positions illustrated in FIG. 6 and are supported on rods 72.

Figure 4:
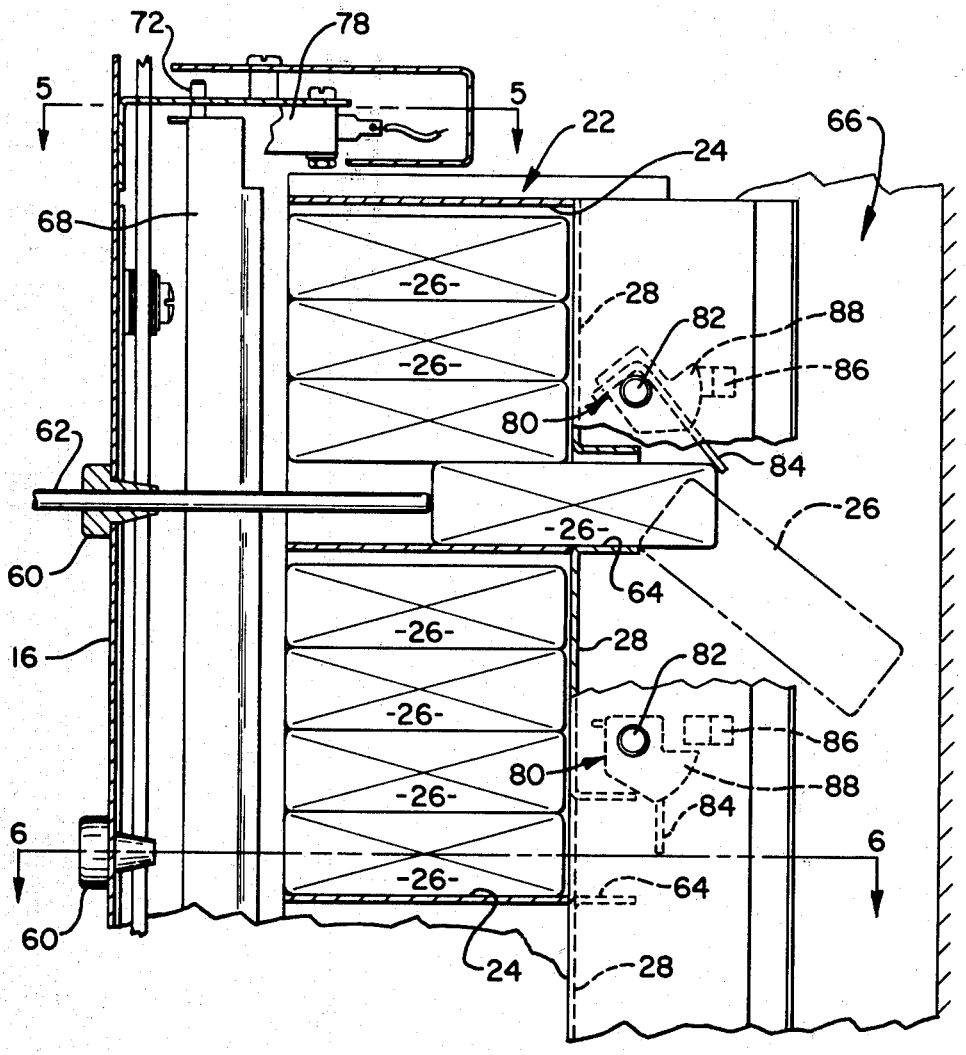
FIG. 4 is a fragmentary vertical cross-sectional view of a portion of the cabinet taken approximately along line 4—4 of FIG. 2.
Figure 5:
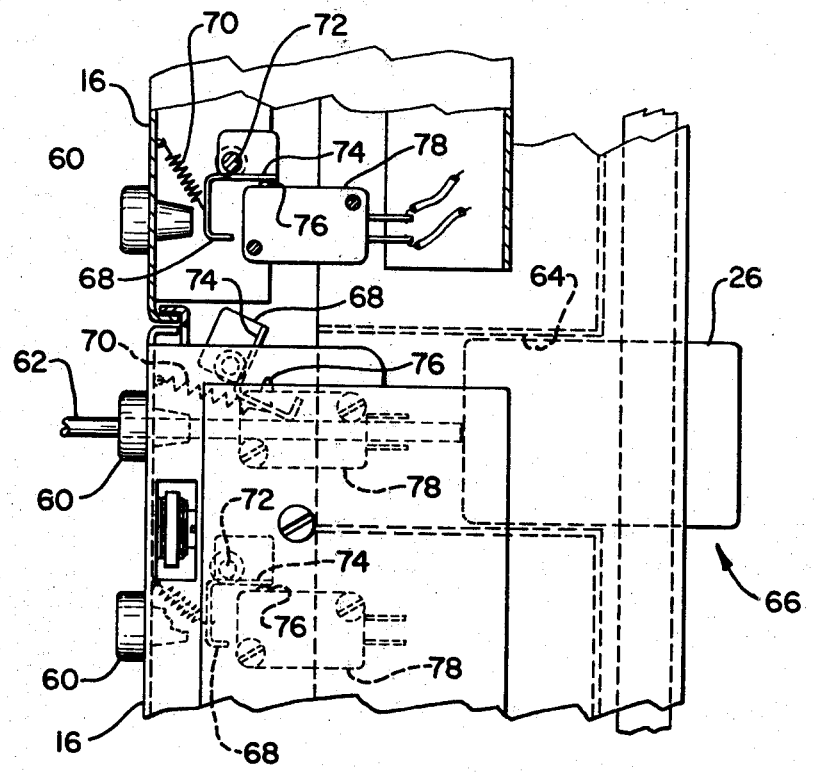
FIG. 5 is a fragmentary partially cross-sectioned view taken generally along line 5—5 of FIG. 4.

In the aforesaid normal position, leg 74 of each vane engages and holds closed the actuating pin 76 of a microswitch 78 or its equivalent (see FIGS. 4 and 5).

Upon insertion of probe 62 into a selected bushing 60, however, the corresponding vertical vane 68 is engaged and caused to rotate on its pivot rod 72 thereby releasing switch pin 76 of microswitch 78 (see FIG. 4 and broken line illustration in FIG. 5).

Each of microswitches 78, being in electrical circuit with control unit 36, cause activation of unit 36 when pin 76 is so released. This affords electrical detection of the particular vertical row of bushings 60 being probed and consequently the particular row of cubicles 24 being probed.

Figure 6:
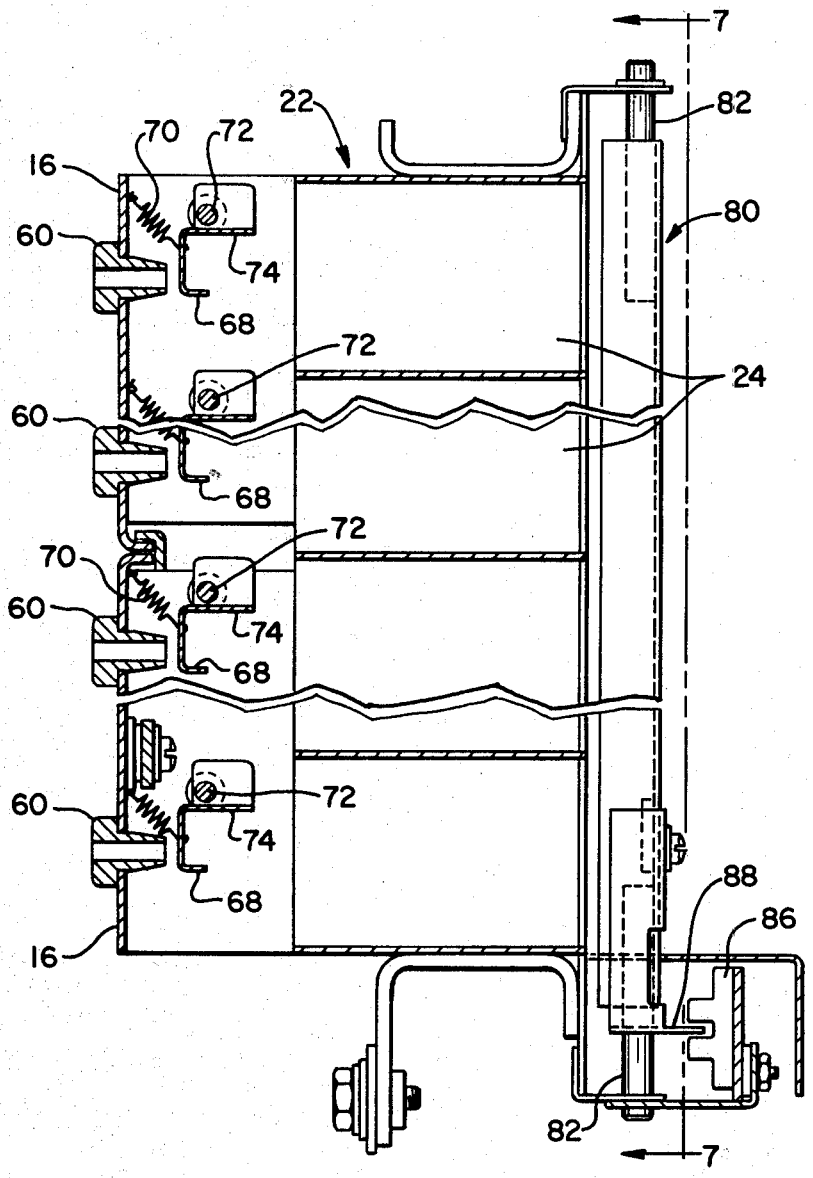
FIG. 6 is another fragmentary cross-sectional view taken approximately along line 6—6 of FIG. 4.
Figure 7:
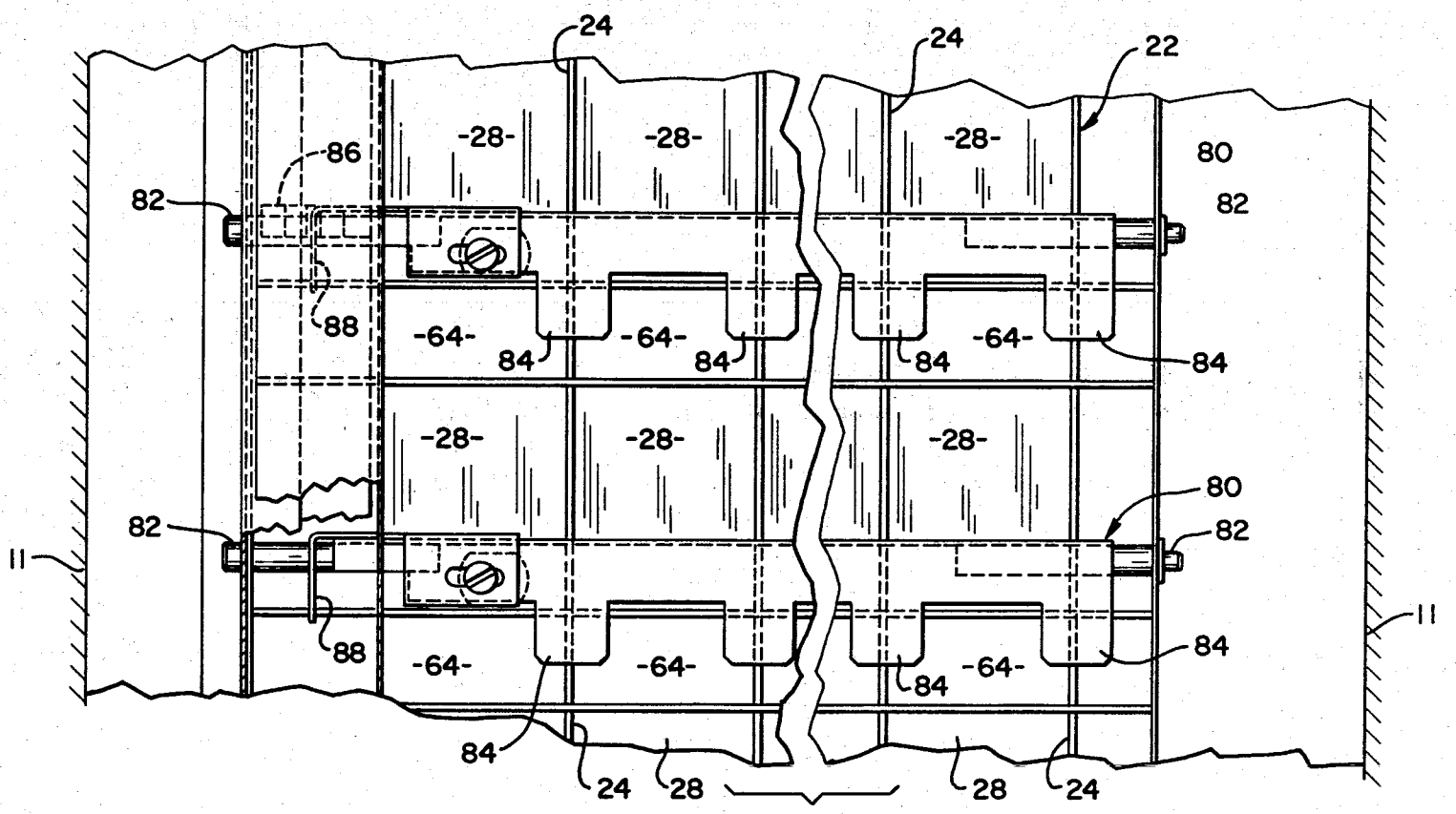
FIG. 7 is still another fragmentary view of a portion of the cabinet taken from line 7—7 of FIG. 6 and looking in the direction of the arrows.

Together with the foregoing, detection of the particular horizontal row of bushings 60 and cubicles 24 being probed is automatically sensed as follows:

Rearwardly of rack 22 and aligned with each horizontal row of package emitting openings 64 is a horizontal (X axis) vane 80 (see FIGS. 6, 7 and 9). Vanes 80 are pivotally mounted in rack 22 upon rods 82 and are provided with depending tabs 84 which normally partially obstruct a portion of each aligned cubicle opening 64. Being gravity held with tabs 84 normally obstructing openings 64 and/or otherwise so biased, movement of a pharmaceutical package 26 through one of openings 64 causes engagement and rotation of a corresponding vane 80, e.g. as illustrated in FIG. 4. This actuation of a vane 80 is electrically sensed by control unit 36 in the following manner.

Adjacent one end of each of horizontal vanes 80 there is fixedly mounted a photoelectric switch 86 (FIGS. 4, 6 and 7) and a flag 88 rotatable with the vane. A suitable switch 86 may comprise Monsanto Model MA-8 supplied by Monsanto Commercial Products Company, Palo Alto, California. Microswitches similar to switches 78 may, alternatively, be used.

Rotation of a vane 80 as illustrated in FIG. 4, by movement of a package 26 into fall space 66, causes flag 88 to interrupt the beam of switch 86 and activate control unit 36. Together with activation of control unit 36 by a particular one of vertical vanes 68, location of the X-Y position of the particular cubicle 24 probed is electrically established and recorded by printer 38 in preselected code form, e.g. as illustrated in FIG. 10. Labelling or otherwise identifying cubicles 24 according to the print-out code provides for accountability of packages dispensed.

For ease and clarity of illustration, only one each of switches 78 and 86 and corresponding vanes 68 and 80 have been shown in FIG. 9. It should be understood, however, that the invention incorporates one switch 78 and vane 68 for each vertical row of cubicles 24 and one switch (or optical interruptor) and vane 80 for each horizontal row of cubicles 24.

It is also pointed out that control unit 36 may comprise any of various combinations and arrangements of commercially available electrical and/or electronic components, the selection and circuitry of which is well within the skills of any artisan required to provide for the aforesaid control unit function.

While control unit 36 and printer 38 components may be placed in any convenient location in cabinet 10, it is presently contemplated that compartment 90 (FIGS. 2 and 3) will serve this purpose.

Below and to one side of compartment 90 are drawers 20 which may be used for bulk storage, e.g. of medications and related items too large for packages 26. With conventional microswitches 94 (FIG. 10) placed within respective drawer spaces, the opening of one or more of drawers 20 will be electrically sensed by control unit 36 and recorded by printer 38.

To the extent thus far described, cabinet 10 requires electrically readable keys for entrance to its operating panels 16 and drawers 20 with such entrance being automatically recorded, i.e. documented on tape 40.

Since it is not deemed necessary, or may not be desirable, to actuate control unit 36 and printer 38 when replacing used stock and/or servicing the recording and other cabinet equipment, separate outer door key lock 96 (FIG. 8) is provided.

Lock 96 (FIGS. 1 and 8) which may be of any conventional mechanical form operates lever 98 which, in turn, releases latch 34. Lock 96 prevails over key reader 34 and solenoid 32 permitting the opening of doors 12 without activation of control unit 36.

Similar conventional mechanical locks 100 and 102 are provided on inner doors 14 and compartment 90 giving the key holder (pharmacist) access to stock rack 22 (FIG. 3) and compartment 90 without activation of control unit 36 and printer 38. Door lock 100 may be in any convenient location other than that illustrated.

Once used packages 26 and/or recording tape 40 are replaced and/or other cabinet servicing is completed, latch plate 46 is returned to its locked position with closing of doors 12. At this point, microswitch 104, having been actuated by the opening of doors 12, is returned to its initial position which renders unit 36 ready for operation of the above-described key reader locking system.

While the foregoing description has emphasized the utility of cabinet 10 as an after-hours medication station, it should be understood that, as a supply cabinet, it has various uses outside the hospital pharmacy/drug environment. For example, it may be used to control office or other supplies requiring accountability.

Those skilled in the art will readily appreciate that there are various other forms and adaptations of the present invention which may be made to suit particular requirements.

Accordingly, the foregoing illustrations are not to be Interpreted as restrictive of the invention beyond that necessitated by the following claims.

We claim:

1. A cabinet for storage and controlled issuing of preselected stock comprising:

a main supporting shell;

a stock supporting rack internally of said shell, said rack including vertically and horizontally aligned rows of stock supporting cubicles which are contoured and designed to support a stack of packaged stock items with barrier means adjacent one side thereof restricting ejection of said items to bottom of the stock item only;

an inner closure for said rack, said inner closure including an operating panel affording limited access to items of stock supported in said rack for controlling dispensing theereof;

means for selective locking and unlocking of said inner closure;

an outer locked closure for said cabinet shell;

means for unlocking and opening of said outer closure for access to said operating panel, said means including an electrical key reader and readable operator assigned keys; and recording means for documenting opening of said outer closure and dispensing of said stock, said recording means identifying key used with date and time of use.

2. A cabinet according to claim 1 wherein said inner closure includes a key operable mechanical lock and said outer closure further includes a key operable mechanical lock, there being provision for said mechanical lock prevailing over said electrical key reader and readable key component.

3. A cabinet according to claim 1 wherein opposite sides of said cubicles are fully open for restocking at top of the stack for last item in, last item out dispensing.

4. A cabinet according to claim 1 wherein said means for documenting dispensing of said stock includes vertically and horizontally disposed mechanical vane means, one of each being adjacent to and extending along respective vertical and horizontal rows of said cubicles for detection of cubicle location and stock dispensed therefrom, said vane means being individually mechanically pivotal and requiring pivoting for dispensing of cubicle supported stock items; electrical switch means associated with each of said vanes and activable by pivoting of said vanes during stock dispensing and said switch means being electrically associated with said recording means for documenting locations of cubicles from which items of stock are dispensed.

5. A cabinet according to claim 4 wherein said recording means includes an electro-mechanical tape printer for documenting said opening of said outer closure and dispensing of said stock.

6. A cabinet according to claim 5 wherein said documentation includes printing of said operator assigned key identification, date and time of use, and location of cubicle(s) from which said cabinet stock is dispensed.

7. A cabinet according to claim 4 wherein said access to stock supported in said rack through said operating panel is accomplished by provision of openings aligned with said items of stock and probe means insertable through said openings against said items of stock.

8. A cabinet according to claim 7 wherein said vertical vanes are disposed adjacent said openings in said operating panel and in juxtaposition with one side of said stock supporting rack and said horizontal vanes are disposed in juxtaposition with the opposite side of said stock supporting rack, said vertical vanes being mechanically actuated by insertion of said probe through said openings in said operating panel and said horizontal vanes being mechanically actuated by movement of said probed stock items thereagainst.

9. A cabinet according to claim 8 wherein said main supporting cabinet shell includes a stock item fall space adjacent said horizontal vanes and retrieval tray therebeneath.

10. A cabinet according to claim 4 wherein said electrical switch means includes a microswitch associated with each of said cabinet vanes and a photoelectric switch associated with each of said horizontal vanes.

11. A cabinet according to claim 10 wherein said photoelectric switches are rendered stationary in said cabinet and respective horizontal vanes include a beam interceptor, the latter intercepting said beam only by pivoting of said horizontal vanes.

* * * * *